United States Patent [19]

Prather

[11] 4,117,571

[45] Oct. 3, 1978

[54] METHOD OF FEEDING COTTON TO A GIN

[76] Inventor: Jimmy F. Prather, Rte. 1, Brownfield, Tex. 79316

[21] Appl. No.: 769,919

[22] Filed: Feb. 18, 1977

[51] Int. Cl.[2] ..... D01G 7/00

[52] U.S. Cl. ..... 19/64.5; 19/80 R; 241/101.7

[58] Field of Search ..... 19/80 R, 81, 145.5, 19/105, 64.5; 156/569–572; 62/321; 241/101.7, 154; 198/511, 513, 304, 308

[56] References Cited

U.S. PATENT DOCUMENTS

| | | | |
|---|---|---|---|
| 488,446 | 12/1892 | Murray | 19/64.5 |
| 2,643,522 | 6/1953 | McLain | 62/321 |
| 3,503,532 | 3/1970 | Bauhon | 19/81 X |
| 3,897,018 | 7/1975 | Wilkes et al. | 19/80 R X |

FOREIGN PATENT DOCUMENTS

| | | | |
|---|---|---|---|
| 917,643 | 9/1954 | Fed. Rep. of Germany | 19/105 |
| 3,087 | 1/1973 | Japan | 19/80 R |
| 26,692 of | 1907 | United Kingdom | 19/105 |

*Primary Examiner*—Dorsey Newton
*Attorney, Agent, or Firm*—Wendell Coffee

[57] ABSTRACT

Cotton on a rick is placed upon a slab adjacent to the gin. A feeder unit having a plurality of drums advances against the rick to move the cotton from the rick onto conveyors to feed the cotton gin. The feeder unit is reversible, so that as soon as a rick is finished in the first direction, it may be reversed to feed against a rick in another direction. The height of the unit is adjustable. Doors close behind the last of the rick to prevent the cotton from scattering, and extending panels on the door contain the cotton along the slab.

1 Claim, 8 Drawing Figures

METHOD OF FEEDING COTTON TO A GIN

BACKGROUND OF THE INVENTION

1. Field of the Invention

This invention relates to cotton harvesting, and more particularly to feeding harvested cotton into cotton gins.

2. Description of the Prior Art

In previous times, cotton was harvested and loaded into wagons. The wagons were transported to the cotton gin where the cotton was sucked from the wagon by suction.

More recently, the cotton has been harvested and placed into ricks by equipment as shown in JONES ET AL, U.S. Pat. No. 3,703,966. The cotton is then picked up while still in the rick by modified haystack transporting devices which are modified trucks similar to SCHILTZ, U.S. Pat. No. 3,298,550. Then the cotton was transported to the gin in ricks to be fed to the gin.

Attempts have been made to feed the ricked cotton into the gin by placing the rick upon a moving platform or conveyor, and moving it to a rick feeder. This would be somewhat similar to the stack processor shown in KANENGIETER ET AL, U.S. Pat. No. 3,920,190. I.e., the rick was fed into the feeder.

Hardwicke-Etter Company of Sherman, Texas has commercially placed on the market a module feeder known by their designation as "Modular Feed-A-Matic", in which the ricks are placed on a slab, and the feeder moves along a track to the ricks. A door at the top of the feeder folds down against the end of the rick to prevent the last of the rick from collapsing. Applicant understands that the Hardwicke-Etter feeder is built according to the disclosure of a patent application filed June 21, 1976 by Jose G. Condarco et al. and which is presently pending in Art Unit 325. When the module finishes feeding the ricks on the slab, it is necessary to reverse the unit to the opposite end of the slab, place another rick upon the slab and begin feeding again.

At the time of filing this application, applicant was aware of other types of equipment for feeding materials. For example, certain ensilage loaders have vehicles which move against piles or ricks of agricultural product and have drums which take the material from the rick and move it to conveyors where it is conveyed to another location. Examples of this are OSWALT, U.S. Pat. No. 2,724,481; OSWALT, U.S. Pat. No. 2,779,452, and BYRD, U.S. Pat. No. 3,724,635.

KLING, U.S. Pat. No. 2,776,036, shows a machine for loading material from stockpiles, quarries and the like.

COBEY, U.S. Pat. No. 3,733,033, has a compost shifting apparatus which has a door-like structure which rides on the compost heap being shifted.

McLain, U.S. Pat. No. 2,643,522, discloses a machine for picking up blocks of ice and commuting them and feeding them into box cars. The machine is mounted upon tracks and has chutes for picking up blocks of ice from either direction according to applicant's understanding of the machine.

SUMMARY OF THE INVENTION

1. New and Different Function

I have invented a machine which feeds cotton from either side; therefore, this greatly facilitates the handling of the ricks at the gin. When the feeder is feeding near the end of the last rick on the slab, another rick may be placed on the other side of the machine. Therefore, when the machine finishes feeding in one direction, it can be reversed for a short distance and immediately begin feeding on another rick which is already positioned on the slab. It will be understood that it is desirable to have cotton fed to the cotton gin with as little delay as possible to prevent the entire cotton gin from being idle. If the feeder feeds in only one direction, it is necessary to have the truck with a module ready to unload standing by at the time of completion of the last rick on the slab, which causes the loaded truck to be idle. With the simple expedient of having the feeder feed in either direction, I have produced equipment which will more readily produce a continuous flow of cotton to the gin and, also, which will cause neither the cotton gin to have excessive idle times nor the truck bringing ricks to the gin to be idle. In addition, I have placed an extension upon the doors which help feed the last remnants of a rick into the feeder so as to enable the loose cotton which may be at the bottom of the slab to be fed into the feeder with as small amount of manual assistance as possible.

Therefore, it may be seen that the function of my combination of elements is far greater than the sum of the function of the individual drums, motors, and other elements.

2. Objects of the Invention

An object of this invention is to feed cotton from a rick to a cotton gin.

Further objects are to achieve the above with a device that is sturdy, compact, durable, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not necessarily to the same scale.

DETAILED DESCRIPTION OF THE PREFERRED EMBODIMENTS

Figure 1:
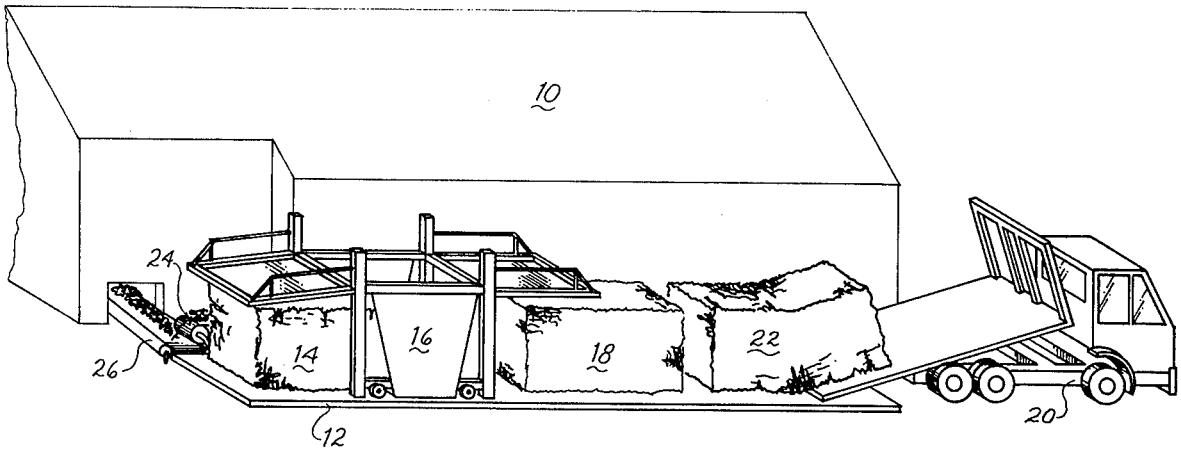
FIG. 1 is a perspective view of a cotton gin with a feeder according to this invention represented in front thereof, with the slab shortened for illustration.

Referring more particularly to FIG. 1, there may be seen a schematic representation of cotton gin 10. Slab 12 adjacent the cotton gin has remnant 14 of a rick of cotton. Feeder unit 16 is advancing against the remnant 14. Rick 18 is upon the elongated slab 12 on the other side of the feeder unit 16 from the remnant 14. The rick 18 is illustrated closer to the feeder 16 than it actually is in practice. Truck 20 is shown unloading yet another rick 22 upon the slab on the far side of the rick 18 from the feeder unit 16.

Slab belt conveyer 24 extends along and adjacent the slab 12. The conveyer 24 receives the cotton from the feeder unit 16 and conveys it to gin conveyer 26 which conveys the cotton from the slab conveyer 24 into the cotton gin 10 for processing. The feeder unit 16 is a means for feeding seed cotton on the slab onto the conveyer along the slab.

Figure 2:
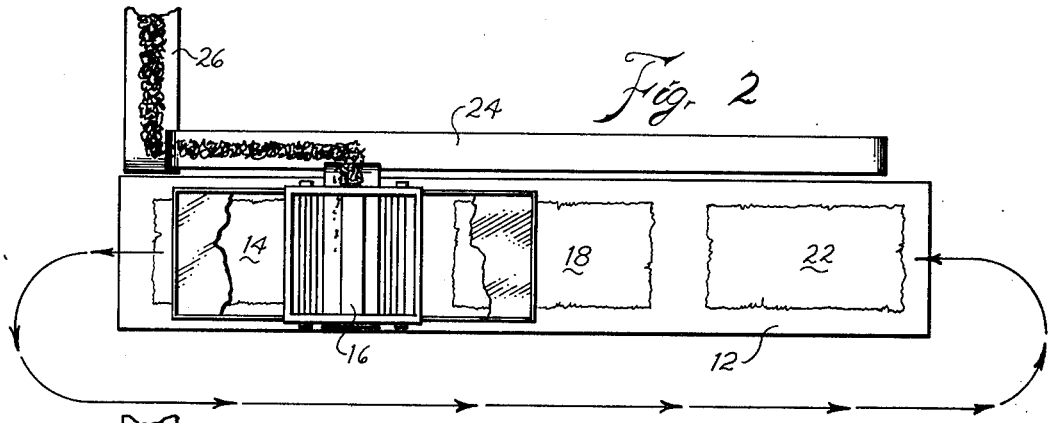
FIG. 2 is a schematic plan representation of a first embodiment of this invention, with the slab shortened for illustration.
Figure 3:
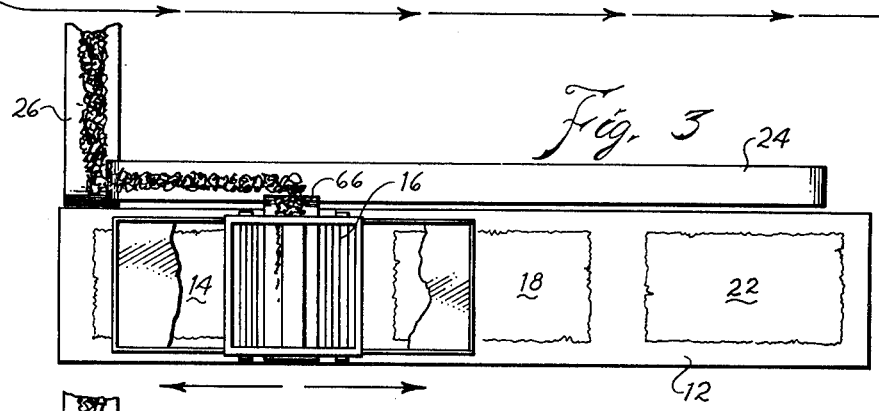
FIG. 3 is a schematic plan representation of a second embodiment, with the slab shortened for illustration.
Figure 4:
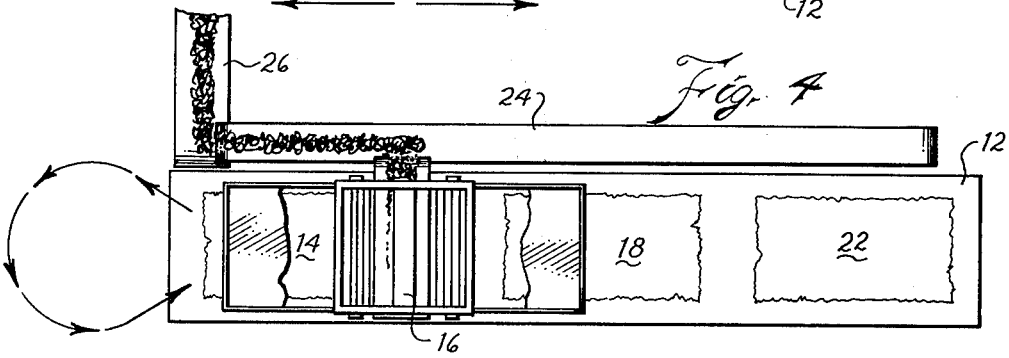
FIG. 4 is a schematic plan representation of a third embodiment, with the slab shortened for illustration.

So that the feeder unit 16 may feed the rick 18 and the rick 22 as soon as it completes the rick 14, three systems are schematically represented in FIGS. 2, 3, and 4.

First, it may be seen that the feeder unit, when it completes feeding the remnant 14, could proceed forward, make a U-turn and then begin feeding upon the rick 18. This is depicted in FIG. 4.

Next, by FIG. 2, it may be seen that the feeder unit 16 upon completion of feeding the remnant 14 could circle around the slab 12 and begin feeding on rick 22, the truck 20 having moved out of the way.

FIG. 3 shows the preferred embodiment. The feeder unit 16 has the capabilities of taking cotton from either side. Therefore, as soon as it finishes feeding remnant 14, the unit is reversed and moved quickly to the rick 18 and begins feeding rick 18.

Analysis shows that with all three systems there need be no precise correlation between the time the truck 20 puts down the rick 18 and the time the remnant 14 is finished. The time the rick of which 14 is a remnant is half or two-thirds fed until it is completely fed, the truck 20 can put down the next rick. After the rick 18 is put down, of course, the rick 22 could be put down as soon as the truck is available. When the feeder unit 16 has fed half or two-thirds of rick 22, another rick can be placed on the slab 12 behind the feeder unit so that as soon as that rick is finished, the unit can be again reversed.

Figures 5, 6, 7:
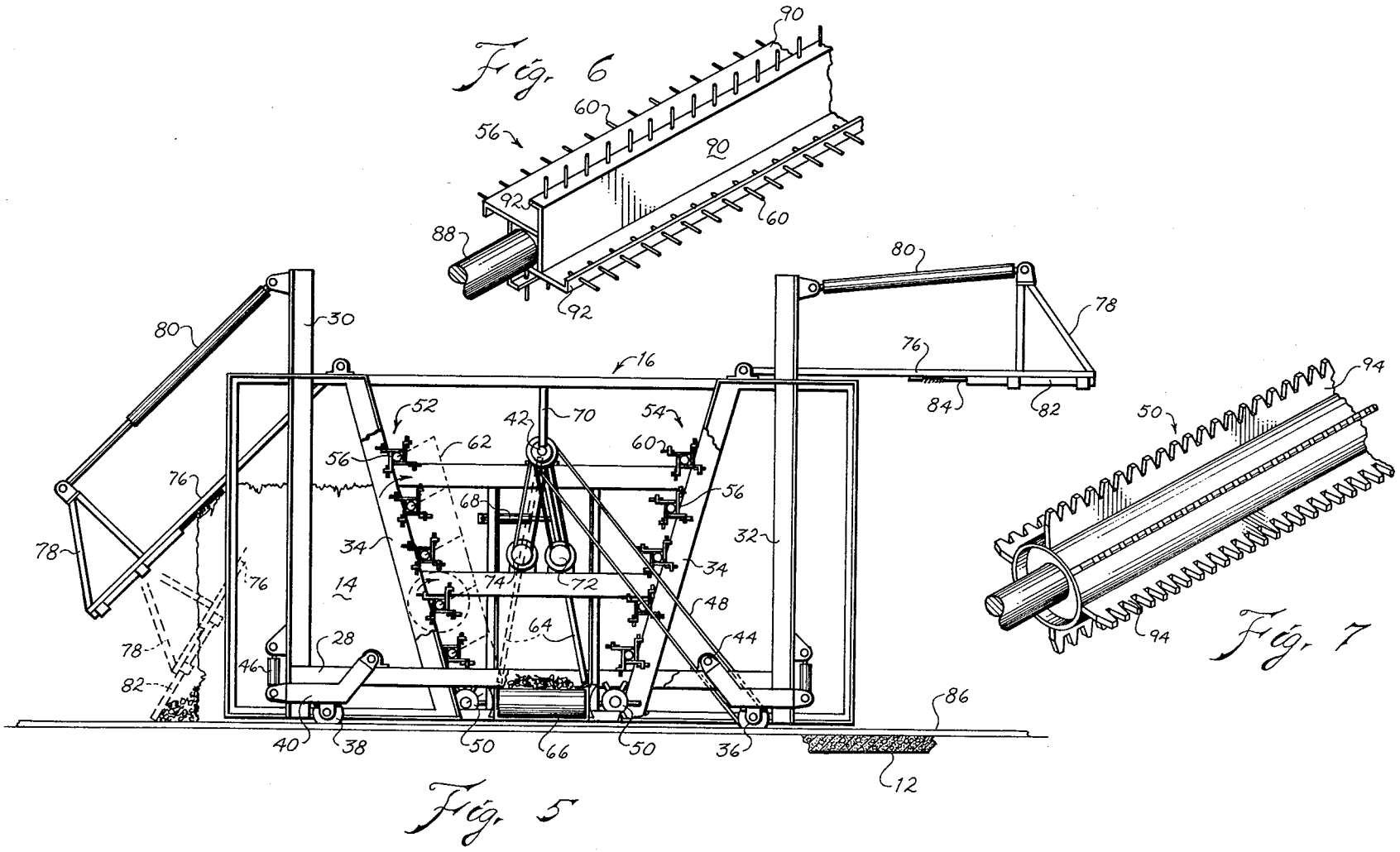
FIG. 5 is a side elevational view of the feeder unit, all covers and shields removed, of the preferred embodiment.
FIG. 6 is a partial prespective view of a feed drum.
FIG. 7 is a partial perspective view of a sweep drum.
Figure 8:
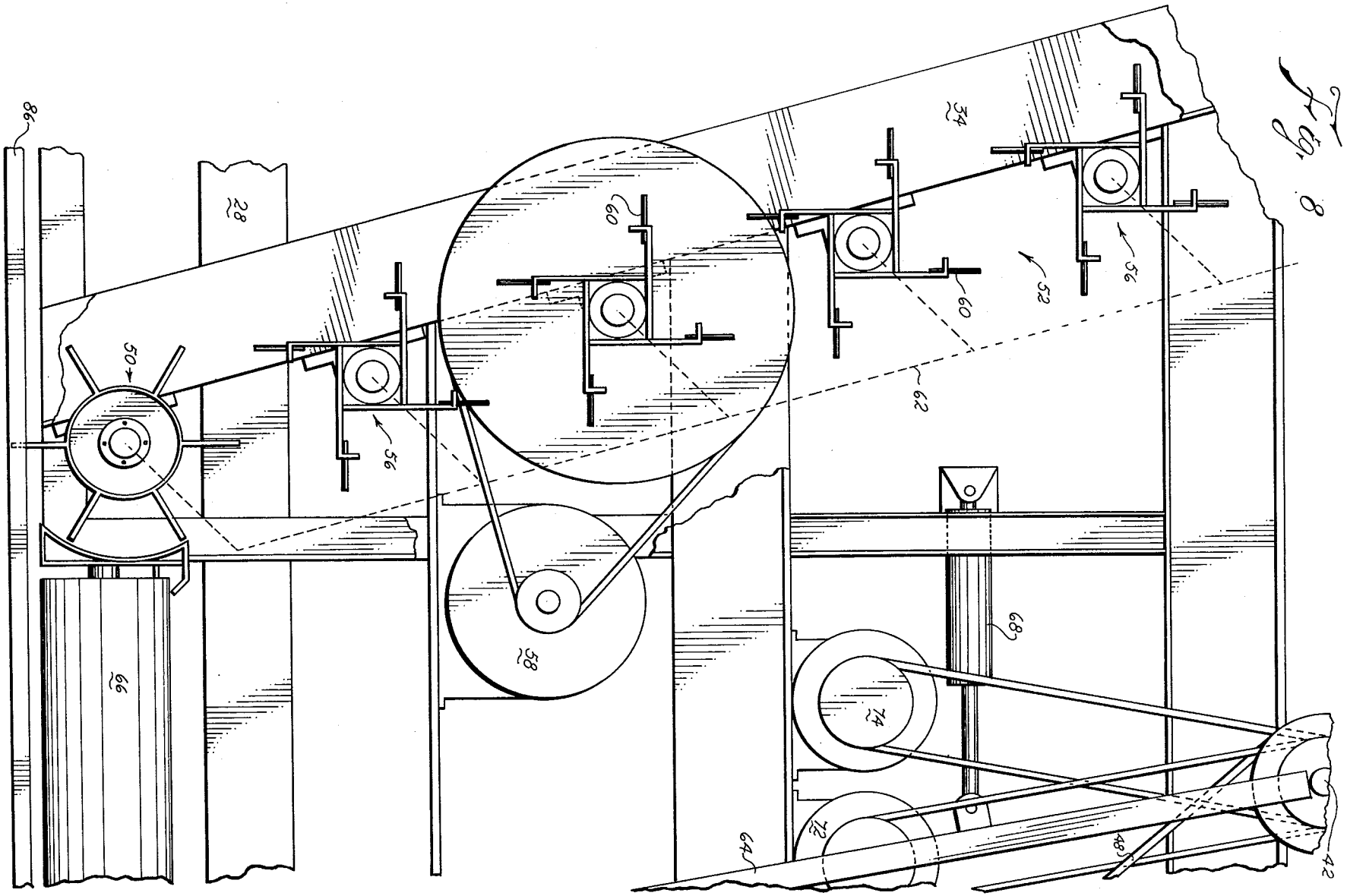
FIG. 8 is a partial side elevational view of the feed unit, being an enlarged portion of FIG. 5.

Referring more specifically to FIG. 5, there may be seen the feeder unit 16. The unit 16 has a frame including main horizontal beam 28. Two door unit supports, one door unit support on each side, are also part of the frame. The supports include vertical stanchions 30 and 32 and drum bank supports 34. It is understood that the frame would have various other structural elements to hold the motors, to structurally strengthen the feeder unit, and to hold the shields which contain the rick of cotton as it is being fed. Since a detailed description of these parts is not necessary to understand my invention nor for those skilled in cotton gin machinery to make and use the invention, some have not been shown in the drawings and others are not described in detail.

The unit is supported by four wheels 36 and 38; each wheel is journaled upon pivoted arm 40. At least two of the wheels 36 are driven from main drive shaft 42. Pivots 44 on which the arms 40 are mounted attach to the main horizontal beam 28 in a line between the drive shaft 42 and the wheel 36. Therefore as the arm 40 is raised and lowered by hydraulic cylinder 46 extending between one of the door stanchions 30 or 32 and the arm 40, belt 48 extending from the main drive shaft 42 to the wheel 36 is neither tightened nor loosened. By mounting the wheels 36 and 38 to be raised or lowered, the height of the sweeper drums 50 in relation to the slab 12 is adjusted. Although only the wheels 36 have been illustrated as being driven, it will be understood by those skilled in the art that all the wheels, including the wheels 38, can be driven if desired. The wheels 36 and 38 are arranged to run on rails 86 along each side of the slab 12.

Two banks 52 and 54 of five feed drums 56 are mounted by suitable bearings to the drum supports 34. Each of the feed drums are identical and are shown in FIG. 6. Electric motor 58 is provided for each bank 52 and 54 of drums. The drums 56 are all rotated at the same speed and in the same direction, and rotated in the direction as shown by the arrow in the drawing. Therefore, fingers 60 on the drums move upward so that as the cotton is dug from the rick, it is moved upward over the top of the drum and into the feeder unit. As seen in the drawing, the top drum of each of the banks 52 and 54 is further from the center line of the feeder unit than the bottom drum and the remaining drums 56 are aligned between the top and bottom drum. The feed drive 62 has been schematically shown from the electric motor 58 to each of the drums 56. Those having ordinary skill in the farming art or in the cotton ginning art will understand how to run a plurality of drums in the same direction and at the same speed.

Movable or swinging partition 64 is suspended from and extends from the main drive shaft 42 to the top of feeder unit conveyer belt 66. The feeder unit belt 66 is a conveyer means for conveying the cotton that has been removed from the rick to the slab conveyer 24. The swinging partition 64 is moved from side to side by partition hydraulic cylinder 68. Fixed partition 70 extends from the main drive shaft 42 to the top of the unit.

The drive shaft 42 is driven by reversible variable speed motor 72. I prefer to use a direct current electric motor. It is necessary to drive the wheels 36 at a very slow rate, and, therefore, the motor 72 is geared down so that the output shaft rotates very slowly. Separate reversible motor 74 drives the main drive shaft 42 in either direction so that the unit 16 may be rapidly moved to a new rick when one rick is finished. The control for the hydraulic cylinder 68 for the movable partition 64 is correlated with the direction of movement of the unit 16. The motors 72 and 74 are part of travel means for moving the unit 16.

Door 76 extends from the top of the unit to a position almost touching the slab 72 when the door 76 is in a down position. The door 76 is pivoted from the top of the unit; the center of the axis about which the door is pivoted is about in line with the working periphery of the drums 56. The door 76 has on its distal end A-frame 78. The upper tip of the A-frame 78 is connected by door hydraulic cylinder 80 to an ear at the top of the door stanchion 30 or 32.

Panel 82 is slidingly attached to the under side of the distal end of the door 76. The panel 82 is the full width of the door 76. The panel 82 is shown attached to the door by clips. It will be understood that the panel could be attached by rollers for ease of movement. The panel 82 is normally held in a retracted position by spring 84 as shown.

Analysis will show that the door can normally be held in the horizontal position by the hydraulic cylinder 80 and in this position the spring 94 will hold the panel 82 retracted. As the unit proceeds to feed into a rick so that only a thin remnant is remaining, the cylinder 82 can be extended to lower the door to fit behind the remnant so that the remnant does not collapse. As the door is lowered, the weight of the panel 82 will overcome the tension of the spring 84 and the panel will extend, touching the slab 12. Then as the unit 16 continues to advance the door, the extension of the hydraulic cylinder 80 is continued so the door brings the remnant to the bank of the feed cylinders 56. At this point the door will be adjacent and parallel the working periphery of the feed drums 56.

Thus, it may be seen that the door hydraulic cylinder 80 forms part of a means for moving the door from a substantial horizontal position to a position substantially parallel to said rick feeder means, i.e., the bank 52 or 54 of the drums. All this time the panel will be along the slab 12 to prevent any loose cotton from scattering. Upon completion of feeding the remnant, the door cylinder 80 can be retracted, raising the door and at which time the spring 84 will retract the panel 82.

Each bank 52 and 54 of the feed drums 56 is identical. Only one bank will be operating at any given time. Of course when one bank is operating, its feed motor 58 will be activated to rotate the feed drums 56 and the feed drums will throw the cotton against the fixed partition 70 and the swinging partition 64. The swinging partition 64 will be in that position according to the movement of the unit, which will also determine which of the banks 52 or 54 is operating. Thus it may be seen that the partition hydraulic cylinder 68 forms means for swinging the partition away from the direction of movement of the feeder unit. The partitions direct the cotton upon the unit conveyor belt 66. Therefore, each of the banks 52 and 54 of drums is a rick feeding means on either side of the feeder unit for feeding seed cotton on the slab onto the conveyer belt 66.

The unit conveyor belt 66 is trained over pulleys which are motor driven. The pulleys of unit belt 66 are aligned with or are parallel with the slab conveyor 24 and the track or rail 86. The unit conveyor pulleys are suitably journaled and supported from the main beams 28. One end of the unit belt 66 extends over the slab conveyer 24 so that the cotton which is dropped onto the unit conveyer belt 66 (as described above) will be conveyed to the slab conveyor, all as will be well understood by those skilled in the art.

Referring to FIG. 6, the feed drum 56 has a main central cylinder 88. Four sheet metal wings or tabs 90 are attached as by welding to the main center cylinder. The peripheral border 92 of these tabs 90 are bent and pierced. Fingers 60 extend through the pierced borders 92 and along the side of the radial portion of the tabs 90. Therefore, the drawing shows the fingers 60 are very securely and radially attached to and form a part of the feeder drum 56.

The sweeper drum 50 is the bottom drum of each of the banks 52 and 54. The sweeper drum feeds cotton from the bottom of the rick, but it also insures that any cotton along the slab is picked up and thrown onto the unit belt 66. The sweeper cylinder 50 has six plates 94 extending longitudinally of the cylinder; the plates are in radial planes. (FIG. 7). Each of the plates 94 has a saw tooth peripheral edge so that the plates tend to sweep the cotton up from along the slab 12 and throw it upward and backward onto the belt 66.

The hydraulic pumps, hoses and controls for the various hydraulic cylinders have not been shown for simplicity, clarity and conciseness of illustration and description. However, those having ordinary skill in the art will be capable of understanding fully how these pumps, controls and hoses would be arranged, as well as how the electric motor controls would be arranged.

As an aid to correlating the terms of the claims to the exemplary drawing, the following catalog of elements is provided:

| | | | |
|---|---|---|---|
| 10 | gin | 52 | bank |
| 12 | slab | 54 | bank |
| 14 | remnant | 56 | feeder drum |
| 16 | feeder unit | 58 | motor, feed |
| 18 | rick | 60 | fingers |
| 20 | truck | 62 | feed drive |
| 22 | rick | 64 | partition, movable |
| 24 | conveyer, slab | 66 | belt, unit |
| 26 | gin conveyer | 68 | partition, hy. cyl. |
| 28 | main beam | 70 | fixed partition |
| 30 | door support | 72 | rev. spd. travel motor |
| 32 | stanchions | 74 | hi. spd. travel motor |
| 34 | drum supports | 76 | door |
| 36 | wheel, driven | 78 | A-frame |
| 38 | wheel | 80 | hydraulic cylinder, door |
| 40 | arm | 82 | panel |
| 42 | main shaft | 84 | spring |
| 44 | pivots | 86 | rail |
| 46 | arm hyd. cylinder | 88 | center portion cylinder |
| 48 | belt, travel | 90 | tabs |
| 50 | sweeper drum | 92 | periphery |
| | | 94 | plates |

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

SUBJECT MATTER CLAIMED FOR PROTECTION

I claim as my invention:

1. In the method of feeding seed cotton to a cotton gin, including a. placing a first rick of seed cotton on a slab and b. advancing a feeder unit against the first rick of seed cotton, thereby c. taking the seed cotton from the first rick into a first side of the feeder unit and feeding it to the gin; the improvement comprising the following steps:

d. placing a second rick of seed cotton on the slab on the opposite side of the feeder unit from the first rick, e. reversing directions of travel of the feeder unit after the first rick is finished feeding into the gin, and f. advancing the feeder unit against the second rick thereby engaging the opposite side of said feeder unit with said second rick, g. taking the seed cotton from the second rick into said opposite side of the feeder unit and feeding it to the gin.

* * * * *